United States Patent [19]

Fehrer

[11] 4,067,181

[45] Jan. 10, 1978

[54] FIBER-DISINTEGRATING UNIT FOR A SPINNING MACHINE

[76] Inventor: Ernst Fehrer, Auf der Gugl 28, Linz, Austria

[21] Appl. No.: 745,075

[22] Filed: Nov. 26, 1976

Related U.S. Application Data

[63] Continuation-in-part of Ser. No. 641,748, Dec. 18, 1975, abandoned.

[30] Foreign Application Priority Data

Jan. 23, 1975 Austria ..... 509/75

[51] Int. Cl.[2] ..... D01H 1/12; D01G 15/40

[52] U.S. Cl. ..... 57/58.91; 19/105; 57/58.95; 241/222

[58] Field of Search ..... 19/105, 106 A, 150; 57/50, 58.89, 58.95; 241/221, 222, 277, 280

[56] References Cited

U.S. PATENT DOCUMENTS

| | | | |
|---|---|---|---|
| 692,601 | 2/1902 | Berger | 241/222 |
| 2,949,645 | 8/1960 | Noda | 19/105 |
| 2,986,348 | 5/1961 | Noll et al. | 241/222 |
| 3,077,641 | 2/1963 | Acki | 19/105 |
| 3,122,904 | 3/1964 | Brandt | 19/105 X |
| 3,188,834 | 6/1965 | Radtke | 19/105 X |
| 3,439,488 | 4/1969 | Buck et al. | 57/58.89 X |
| 3,635,271 | 1/1972 | Markham | 241/222 |
| 3,695,022 | 10/1972 | Landwehrkamp | 57/58.95 X |
| 3,762,144 | 10/1973 | Didek et al. | 57/58.91 |
| 3,837,586 | 9/1974 | Perschbacher et al. | 241/222 X |
| 3,938,746 | 2/1976 | Nordgren | 241/280 X |
| 3,972,173 | 8/1976 | Fehrer | 57/58.95 X |

*Primary Examiner*—John Petrakes
*Attorney, Agent, or Firm*—Kurt Kelman

[57] ABSTRACT

A unit for disintegrating a sliver into spinnable fibers fed to a spinning machine comprises a fiber-disintegrating drum with serrations generating a cylinder on rotation of the drum. A first smooth feed roller guides the sliver to the cylinder and defines therewith a first and second wedge-shaped space on the sides of which the serrations approach and depart from the first feed roller during a rotation, and this feed roller may be adjustably spaced from the cylinder. A second clamping and smoothing feed roller is disposed in the first wedge-shaped space and defines a nip with the first feed roller, the feed rollers being operable to feed the sliver through the nip to the serrations. A cover extends into the second wedge-shaped space and is closely spaced from the first feed roller and as closely as possible from the cylinder. A first pair of pinch rollers feed the sliver to the nip and a second pair of pinch rollers feed the sliver to the first pair of pinch rollers, the first pair of pinch rollers being driven at a higher speed than the second pair of pinch rollers, and the feed rollers being driven at a higher speed than the first pair of pinch rollers.

2 Claims, 3 Drawing Figures

FIBER-DISINTEGRATING UNIT FOR A SPINNING MACHINE

Figure 1:
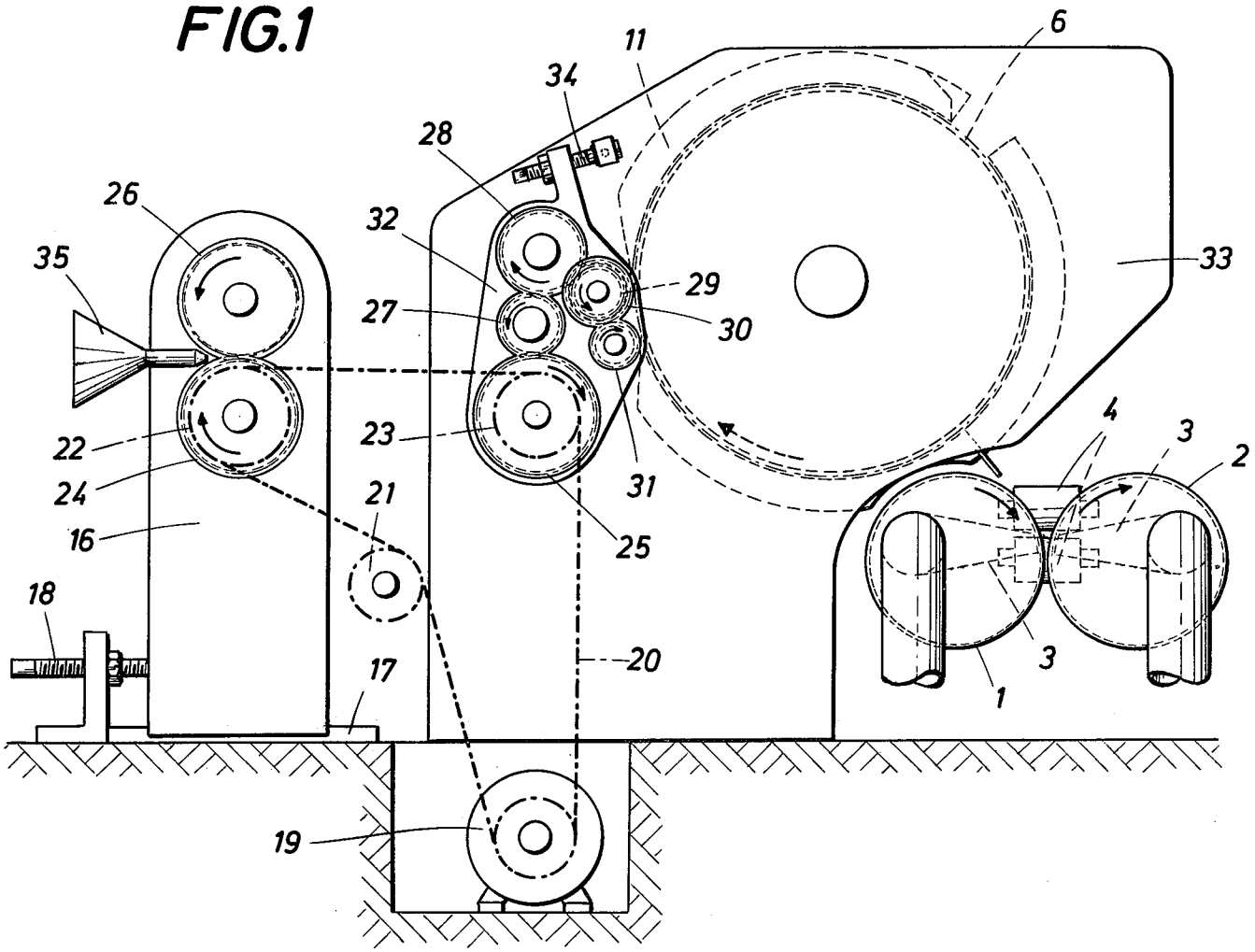

This is a continuation-in-part application of my copending application Ser. No. 641,748, filed Dec. 18, 1975, now abandoned.

The present invention relates to a unit in a spinning machine for disintegrating a fibrous mass, such as a sliver, into spinnable fibers, such as cotton, lamb's wool, synthetic textile fibers and like spinnable fibers. Fiber-disintegrating units of this type precede a spinning station in the spinning machine to feed the disintegrated spinnable fibers to the spinning station, and this invention is concerned more particularly with the feeding mechanism for feeding the fibrous mass to a rotatable fiber-disintegrating serrated drum.

The feeding mechanism comprises a pair of feed rollers defining a nip in which the approaching fibrous mass, i.e. the sliver, is virtually retained so that it may be combed out by the serrations of the drum which rotates at high speed. In known feeding mechanisms, there is a relatively large free space behind that feed roller of the pair which guides the fibrous mass from the nip to the drum. For this reason, the fibrous mass may form a beard on the delivery end of the gap defined by this feed roller and the drum. The formation of this beard is due to the fact that part of the fibers of the mass are entrained by the rotating feed roller to move upwardly and away from the drum. This action causes the fibrous mass to build up. The built-up fibrous mass then falls back onto the drum so that the material is disintegrated on the drum serrations at different rates in successive periods of time. This disadvantage will arise particularly when the fibrous mass is fed at relatively high velocity, as is the case with fiber-disintegrating units preceding a spinning station of a spinning machine.

It has previously been attempted to minimize the distance from the feed roller which guides the fibrous mass to the cylinder generated by the serrations of the drum. Experiments have shown, however, that a decrease of the distance of the feed roller from the drum results in a higher proportion of fibers which are shortened as they are combed out on the drum serrations. On the other hand, particularly in fiber-disintegrating units which precede a spinning station of a spinning machine, it is desirable to avoid shortening of the fibers as much as possible because the tensile strength of the spun yarn will be greatly reduced when the fibers are shortened because it depends to a high degree on the staple length of the fibers.

Frequently, crimped or curled slivers are fed to the fiber-disintegrating unit and such irregularities in the sliver surface also have an adverse effect on the uniformity of the subsequent combing operation.

It is an object of the invention to eliminate the above disadvantages and to provide a feeder mechanism ensuring a uniform fiber disintegration and a careful handling of the fibrous mass.

The above and other objects are accomplished in accordance with the present invention with a unit for disintegrating a fibrous mass, such as a sliver, into spinnable fibers, which unit forms part of a spinning machine and comprises a drum for disintegrating the mass into spinnable fibers. The drum has serrations generating a cylinder and is operable to rotate in a predetermined direction. A first smooth feed roller guides the mass and is disposed adjacent the cylinder. It defines with the cylinder first and second wedge-shaped spaces, respectively, on the side of which the serrations approach and depart from the first feed roller during a rotation of the drum in the predetermined direction. The first feed roller is mounted for adjustment to vary the distance thereof from the cylinder. A second clamping and smoothing feed roller is disposed in the first wedge-shaped space and defines a nip with the first feed roller, the feed rollers being operable to feed the mass through the nip to the serrations. A cover extends into the second wedge-shaped space and is closely spaced from the first feed roller and spaced as closely as possible from the cylinder. A first pair of pinch rollers is operable to feed the fibrous mass between them to the nip and a second pair of pinch rollers is operable to feed the fibrous mass between them to the first pair of pinch rollers. Means is provided for driving the second pair of pinch rollers, for driving the first pair of pinch rollers at a peripheral velocity higher than that of the second pair of pinch rollers, and for driving the first and second feed rollers at a peripheral velocity higher than that of the first pair of pinch rollers.

Because a cover is provided which is closely spaced from the feed roller guiding the fibrous mass, the distance of the cover from the cylinder generated by the drum serrations is minimized, and the feed roller guiding the fibrous mass is smooth, the fibrous mass will not build up and will not form a beard. This results in a much more uniform disintegration of the fibrous mass into spinnable fibers.

The pairs of pinch rollers rotating at different peripheral velocities stretch the received sliver until it reaches the combing station on the serrated drum. As a result, the sliver will have no crimp or curl when it reaches the combing station and the uniformity of the disintegration of the fibrous mass is thus further increased.

Because the distance between the feed roller which guides the fibrous mass and the drum is variable, an influence can be exerted upon the length of the spinnable fibers into which the mass is disintegrated. It has been found, for instance, that the length of the fibers will increase when the distance is increased. On the other hand, the extent to which this distance can be increased is comparatively small, of an order of a fraction of a millimeter. In any case, the fiber lengths may in this way be adjusted. This is particularly significant in the processing of continuous filaments or of tow of continuous filaments.

Figure 2:
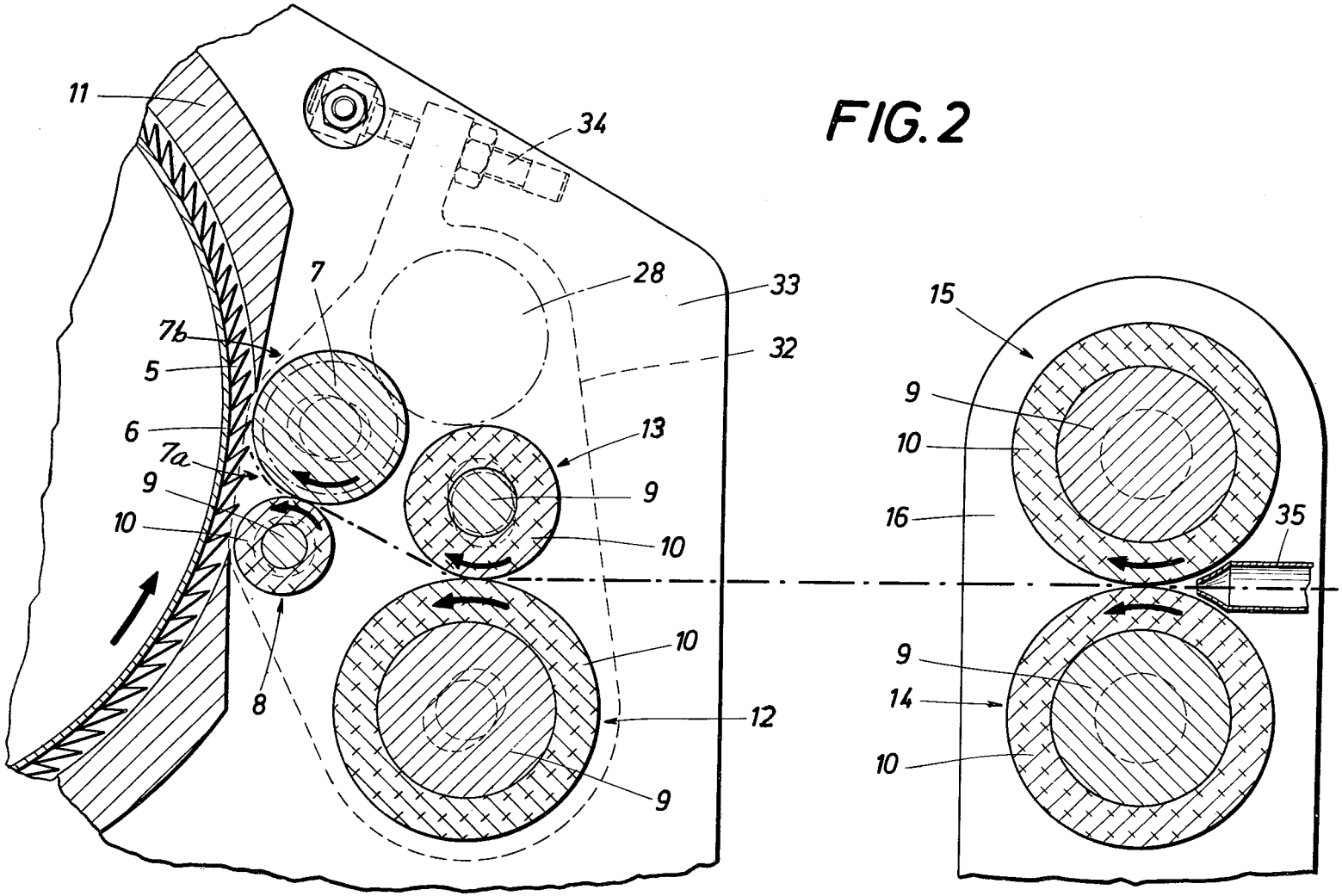
Figure 3:
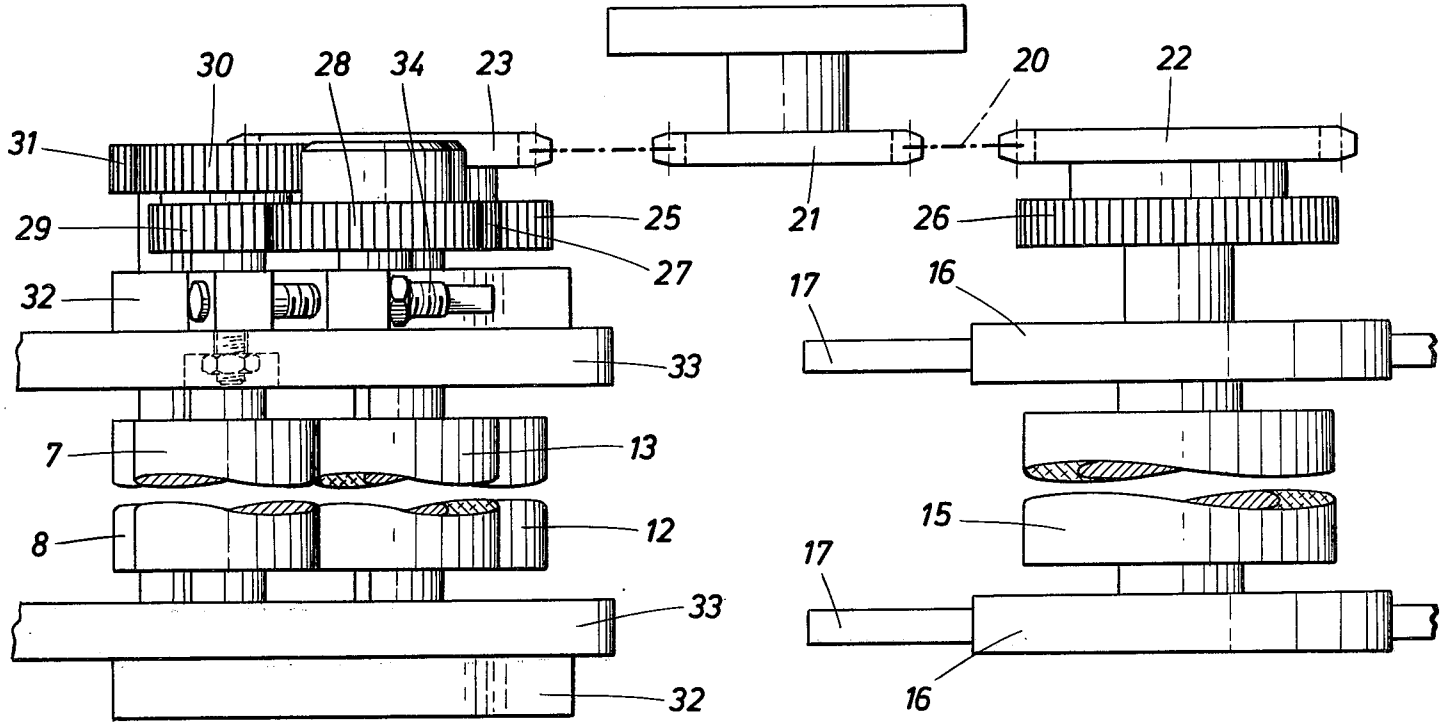

The above and other objects, advantages and features of this invention will become more apparent from the following detailed description of a now preferred embodiment thereof, taken in conjunction with the accompanying drawing wherein FIG. 1 is a side elevational view of a machine for spinning fibers, including the fiber-disintegrating unit of this invention;

FIG. 2 is an enlarged partial view, in vertical section, of the essential parts of the feeding mechanism for the unit; and FIG. 3 is a top view of FIG. 2.

Referring now to the drawing and first to FIG. 1, the spinning station of the illustrated, generally conventional spinning machine comprises two perforated suction drums 1 and 2 rotating in opposite directions and comprising suction inserts 3, 3 defining a suction zone therebetween in the nip of the drums. The fibers to be spun are delivered into the nip in free flight and are twisted in the nip to form a yarn, the yarn being drawn off by a pair of nip rollers 4, 4 which hold the spin yarn therebetween against rotation while it is drawn off. A spinning station of this type is conventional and disclosed, for instance, in my U.S. Pat. No. 3,913,310, dated Oct. 21, 1975, whose disclosure, as far as pertinent, is incorporated herein by way of reference.

This spinning station is preceded by a unit for disintegrating a fibrous mass, such as a sliver, into spinnable fibers for delivery to the spinning station. This unit comprises carding drum 6 rotatable at a high peripheral velocity, i.e. from about 2000 rpm to 4200 rpm, in a predetermined direction indicated by a heavy arrow, the carding drum having serrations 5 generating a cylinder during rotation of the carding drum.

As is shown more clearly in FIG. 2, the feeding mechanism to drum 6 comprises a first smooth feed roller 7 for guiding the fibrous mass indicated in chain-dotted line and a second, smaller clamping and smoothing feed roller 8 defining a nip with the first roller. The surface of feed roller 7 is of polished metal to impart smoothness thereto, and this feed roller is disposed adjacent the cylinder generated by drum serrations 5 and defines with the cylinder first and second wedge-shaped spaces, 7a and 7b respectively, on the sides of which the serrations approach and depart from the feed roller 7 during a rotation of drum 6 in the predetermined direction. The second feed roller 8 comprises hard core 9 and elastic surface layer 10, for instance of rubber. This clamping and smoothing feed roller is disposed in the first wedge-shaped space 7a and defines a nip with feed roller 7, the feed rollers being operable by rotation in opposite directions, as indicated by heavy arrows, to feed the fibrous mass through the nip to serrations 5 of the carding drum. Cover 11 extends into the second wedge-shaped space 7 and is closely spaced from the first feed roller 7 and spaced as closely as possible from the cylinder generated by the serrations. As shown, rollers 7 and 8 are in surface contacts and their axes of rotation are at a fixed distance during operation. The cover prevents upward displacement of the fiber front ends and assures their forward movement without delay. The cover is mounted in side support plates 33 for carding drum 6.

A first pair of pinch rollers 12 and 13 is operable by rotation in opposite directions, as shown by heavy arrows, to feed the fibrous mass between them to the nip between feed rollers 7 and 8. A second pair of pinch rollers 14 and 15 is operable by rotation in opposite directions, as shown by heavy arrows, to feed the fibrous mass between them to pinch rollers 12, 13, the pinch rollers all being comprised of hard core 9 and elastic surface layer 10. As shown, rollers 12, 13 and 14, 15, respectively, are in surface contact and their axes of rotation are at a fixed distance during operation.

The fibrous mass, such as a sliver, roving, tow or the like of spinnable fibers, is fed from funnel 35 to the pair of pinch rollers 14, 15 whence it is delivered to the pair of pinch rollers 12, 13 which feed the fibrous mass to the nip of feed rollers 7, 8 where it is taken up by serrations 5 of the carding drum to be disintegrated into spinnable fibers. The disintegrated fibers fly off drum 6 under the action of centrifugal force into the nip of suction drums 1, 2 where they are twisted and spun into yarns.

Pinch rollers 14, 15 are mounted in block 16 and this mounting block is arranged for movement along guide rail 17 for adjustment of the distance between this pair of rollers and the pair of pinch rollers 12, 13, set screw 18 engaging the mounting block for moving the same a desired distance upon rotation of the set screw.

Providing an elastic surface layer for all the pinch rollers and feed roller 8 will ensure that the sliver or like fibrous mass is reliably clamped between the rollers because the elastic surface layer will adapt itself to any cross-sectional shape of the mass. Such reliable clamping will improve the uniformity of the combing or disintegrating operation on drum 6. Varying the distance between the pairs of pinch rollers enables the unit to be adapted to different lengths of fibers of the sliver. The distance between the nips of the pinch rollers must be smaller than the average length of the individual fibers of the sliver if uniform stretching is to be effected.

Common motor 19 drives feed rollers 7, 8 and both pairs of pinch rollers 12, 13 and 14, 15, drive chain 20 being held under tension by sprocket 21 (see FIG. 1) and trained over sprocket 22 keyed to the shaft of pinch roller 14 as well as sprocket 23 keyed to the shaft of pinch roller 12. As shown, the diameter of sprocket 22 exceeds that of sprocket 23 so that roller 12 is driven at a peripheral velocity higher than that of roller 14. Also keyed to the shafts of pinch rollers 12 and 14 are sprockets 25 and 24, sprocket 24 meshing with sprocket 26 keyed to the shaft of pinch roller 15 and sprocket 25 meshing with sprocket 27 keyed to the shaft of pinch roller 13 so that the pinch rollers of each pair are driven in unison. The ratio of the diameters of sprockets 22 and 23 preferably is such that the peripheral velocity of pinch rollers 12, 13 is about 6% higher than that of pinch rollers 14, 15, the usual peripheral velocity of pinch rollers 14, 15 being in the range of about 4.9 meters/minute.

Sprocket 27 also meshes with intermediate sprocket 28 which, in turn, meshes with sprocket 29 keyed to the shaft of feed roller 7. Sprocket 30 is also keyed to this shaft and meshes with sprocket 31 keyed to the shaft of feed roller 8 so that the feed rollers are driven in unison by intermediate sprocket 28. The sprocket diameter ratios are preferably so selected that the peripheral velocity of feed rollers 7, 8 is about 20% higher than that of pinch rollers 12, 13.

The shafts of feed rollers 7, 8 and pinch rollers 12, 13 are journaled in a pair of cheek plates forming roller mount 32 and the cheek plates of the mount are pivotal about the shaft of roller 8 in side support plates 33 for carding drum 6. The shafts of rollers 7, 12 and 13 are journaled in elongated slots in side support plates 33 (see FIG. 2) to enable mounts 32 to be pivoted about the shaft of roller 8 by means of set screw 34, thus mounting feed roller 7 for adjustment to vary the distance thereof from the cylinder generated by serrations 5 of carding drum 6. Upon operation of the set screw, this direction is varied as the roller mount is swung in the direction of the drum.

The increasing peripheral velocity of the rollers feeding the fibrous mass to the carding drum enables the mass to be stretched as it approaches the drum.

What is claimed is:

1. In a spinning machine, a unit for disintegrating a fibrous mass into spinnable fibers, the unit comprising a. a drum for disintegrating the mass into spinnable fibers, the drum having serrations generating a cylinder and being operable to rotate in a predetermined direction, b. a first smooth feed roller for guiding the mass, the first feed roller being disposed adjacent the cylinder and defining with the cylinder first and second wedge-shaped spaces, respectively, on the sides of which the serrations approach and depart from the first feed roller during a rotation of the drum in the predetermined direction, the first feed roller being mounted for adjustment to vary the distance thereof from the cylinder, c. a second clamping and smoothing feed roller comprising a hard core and an elastic surface layer, the second feed roller being disposed in the first wedge-shaped space and defining a nip with the first feed roller, (1) the feed rollers being in surface contact, having axes of rotation at a fixed distance during operation and being operable to feed the mass through through the nip to the serrations, d. a cover extending into the second wedge-shaped space, the cover being closely spaced from the first feed roller and spaced as closely as possible from the cylinder, e. a first pair of pinch rollers operable to feed the fibrous mass between them to the nip, f. a second pair of pinch rollers operable to feed the fibrous mass between them to the first pair of pinch rollers, each of the pinch rollers comprising a hard core and an elastic surface layer, and each pair of pinch rollers having axes of rotation at a fixed distance during operation, and g. means for driving the second pair of pinch rollers, for driving the first pair of pinch rollers at a peripheral velocity higher than that of the second pair of pinch rollers, and for driving the first and second feed rollers at a peripheral velocity higher than that of the first pair of pinch rollers.

2. In the spinning machine of claim 1, the first and second pairs of pinch rollers being mounted for adjustment of the distance between these pairs of rollers.

* * * * *